US008306189B2

(12) United States Patent
Brown et al.

(10) Patent No.: US 8,306,189 B2
(45) Date of Patent: Nov. 6, 2012

(54) X-RAY APPARATUS

(75) Inventors: Kevin John Brown, Horsham (GB); Maria Giulia Thompson, Redhill (GB); Vibeke Nordmark Hansen, Sutton (GB); Philip Mark Evans, Sutton (GB); David Anthony Roberts, South Croydon (GB)

(73) Assignees: Elekta AB (Publ), Stockholm (SE); The Institute of Cancer Research, London (GB)

( * ) Notice: Subject to any disclaimer, the term of this patent is extended or adjusted under 35 U.S.C. 154(b) by 202 days.

(21) Appl. No.: 12/809,238

(22) PCT Filed: Dec. 21, 2007

(86) PCT No.: PCT/EP2007/011342

§ 371 (c)(1),
(2), (4) Date: Jun. 18, 2010

(87) PCT Pub. No.: WO2009/080080

PCT Pub. Date: Jul. 2, 2009

(65) Prior Publication Data

US 2010/0310045 A1 Dec. 9, 2010

(51) Int. Cl.
*H01J 35/00* (2006.01)

(52) U.S. Cl. ..... 378/125; 378/143

(58) Field of Classification Search ..... None
See application file for complete search history.

(56) References Cited

U.S. PATENT DOCUMENTS

| | | | | |
|---|---|---|---|---|
| 4,541,106 | A | 9/1985 | Belanger | 378/99 |
| 5,471,516 | A * | 11/1995 | Nunan | 378/65 |
| 2002/0101958 | A1 * | 8/2002 | Bertsche | 378/143 |
| 2004/0247082 | A1 * | 12/2004 | Hoffman | 378/119 |

OTHER PUBLICATIONS

International Searching Authority, International Search Report and Written Opinion pertaining to International application No. PCT/EP2007/011342, dated Sep. 19, 2008, 14 pages.

* cited by examiner

*Primary Examiner* — Hoon Song
(74) *Attorney, Agent, or Firm* — Sunstein Kann Murphy & Timbers LLP

(57) ABSTRACT

X-ray apparatus comprises a linear accelerator adapted to produce a beam of electrons at one of at least two selectable energies and being controlled to change the selected energy on a periodic basis, and a target to which the beam is directed thereby to produce a beam of x-radiation, the target being non-homogenous and being driven to move periodically in synchrony with the change of the selected energy. In this way, the target can move so that a different part is exposed to the electron beam when different pulses arrive. This enables the appropriate target material to be employed depending on the selected energy. The easiest form of periodic movement for the target is likely to be a rotational movement.

17 Claims, 6 Drawing Sheets

X-RAY APPARATUS

FIELD OF THE INVENTION

The present invention relates to x-ray apparatus.

BACKGROUND ART

In the use of radiotherapy to treat cancer and other ailments, a powerful beam of the appropriate radiation is directed at the area of the patient that is affected. This beam is apt to kill living cells in its path, hence its use against cancerous cells, and therefore it is highly desirable to ensure that the beam is correctly aimed. Failure to do so may result in the unnecessary destruction of healthy cells of the patient.

Several methods are used to check this, and devices such as the Elekta™ Synergy™ device employ two sources of radiation, a high energy accelerator capable of creating a therapeutic beam and a lower energy X-ray tube for producing a diagnostic beam. Both are mounted on the same rotateable gantry, separated by 90°. Each has an associated flat-panel detector, for portal images and diagnostic images respectively.

In our earlier application WO-A-99/40759, we described a novel coupling cell for a linear accelerator that allowed the energy of the beam produced to be varied more easily than had hitherto been possible. In our subsequent application WO-A-01/11928 we described how that structure could be used to produce very low energy beams, suitable for diagnostic use, in an accelerator that was also able to produce high-energy therapeutic beams. Later, in WO2006/097697A1 we described how to switch between those high- and low-energy beams at high speed. The disclosure of all of these prior disclosures is hereby incorporated by reference. The reader should note that this application develops the principles set out in those applications, which should therefore be read in conjunction with this application and whose disclosure should be taken to form part of the disclosure of this application.

SUMMARY OF THE INVENTION

The Elekta™ Synergy™ arrangement works very well, but requires some duplication of parts in that, in effect, the structure is repeated to obtain the diagnostic image. In addition, care must be taken to ensure that the two sources are in alignment so that the diagnostic view can be correlated with the therapeutic beam. However, this has been seen as necessary so that diagnostic images can be acquired during treatment to ensure that the treatment is proceeding to plan.

WO-A-01/11928 shows how the accelerator can be adjusted to produce a low-energy beam instead of a high-energy beam, and WO2006/097697 A1 shows how the two beams could be produced (effectively) simultaneously as is required for concurrent therapy and monitoring.

The present invention therefore provides an X-ray apparatus comprising a linear accelerator adapted to produce a beam of electrons at one of at least two selectable energies and being controlled to change the selected energy on a periodic basis, and a target to which the beam is directed thereby to produce a beam of x-radiation, the target being non-homogenous and being driven to move periodically in synchrony with the change of the selected energy.

In this way, the target can move so that a different part is exposed to the electron beam when different pulses arrive. This enables the appropriate target material to be employed depending on the selected energy.

The easiest form of periodic movement for the target is likely to be a rotational movement. The target can be immersed in a coolant fluid such as water.

The linear accelerator can be of the type comprising a series of accelerating cavities, adjacent pairs of which are coupled via coupling cavities, at least one coupling cavity comprising a rotationally asymmetric element that is rotateable thereby to vary the coupling offered by that cavity and thereby select an energy. It can further comprise a control means adapted to control operation thereof and control rotation of the asymmetric element, arranged to operate the accelerator in a pulsed manner and to rotate the asymmetric element between pulses to control the energy of successive pulses. Generally, we prefer that rotation of the asymmetric element is continuous during operation of the linear accelerator.

The target preferably contains at least one exposed area of a first material and/or at least one exposed area of a second material. Suitable materials are tungsten and carbon, but others will also be suitable. These can be present as inhomogeneities in the material of which the target is composed, such as Carbon inserts in a Tungsten substrate (or vice versa), alternating segments of Carbon and Tungsten, Carbon and Tungsten inserts in a substrate of a third material, or arrangements involving other materials in addition to or instead of Carbon and/or Tungsten.

Alternatively, or in addition, the target can have inhomogeneities in its thickness to cater for the different electron energies. Thickness differences may cause interesting weight distributions (depending on their spatial distribution), which could be balanced by partially, fully or over-filling the thinner areas with an inert material.

Most X-ray apparatus include one or more filters for the x-radiation, such as flattening filters and diagnostic x-ray filters. These are usually matched to the energy distribution of the x-rays being filtered. We therefore propose that the apparatus comprise a filter housing, in which there are a plurality of filters, the housing being driven to move periodically in synchrony with the change of the selected energy, i.e. a filter using essentially the same inventive concept as that set out above in relation to the target.

Accordingly, the present invention further provides an X-ray apparatus comprising a linear accelerator adapted to produce a beam of electrons at one of at least two selectable energies and being controlled to change the selected energy on a periodic basis, a target to which the beam is directed thereby to produce a beam of x-radiation, and a filter housing, in which there are a plurality of filters for the x-radiation, the housing being driven to move periodically in synchrony with the change of the selected energy.

A detector can be located in the path of the beam, to acquire an image produced by the beam after attenuation thereof. This is preferably driven by a control means operating in synchrony with the control of changes to the selected energy of the linear accelerator.

The above x-ray apparatus can, for example, form a part of a radiotherapy apparatus. In that case, the first selected energy can be a diagnostic energy and a second selected energy a therapeutic energy.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
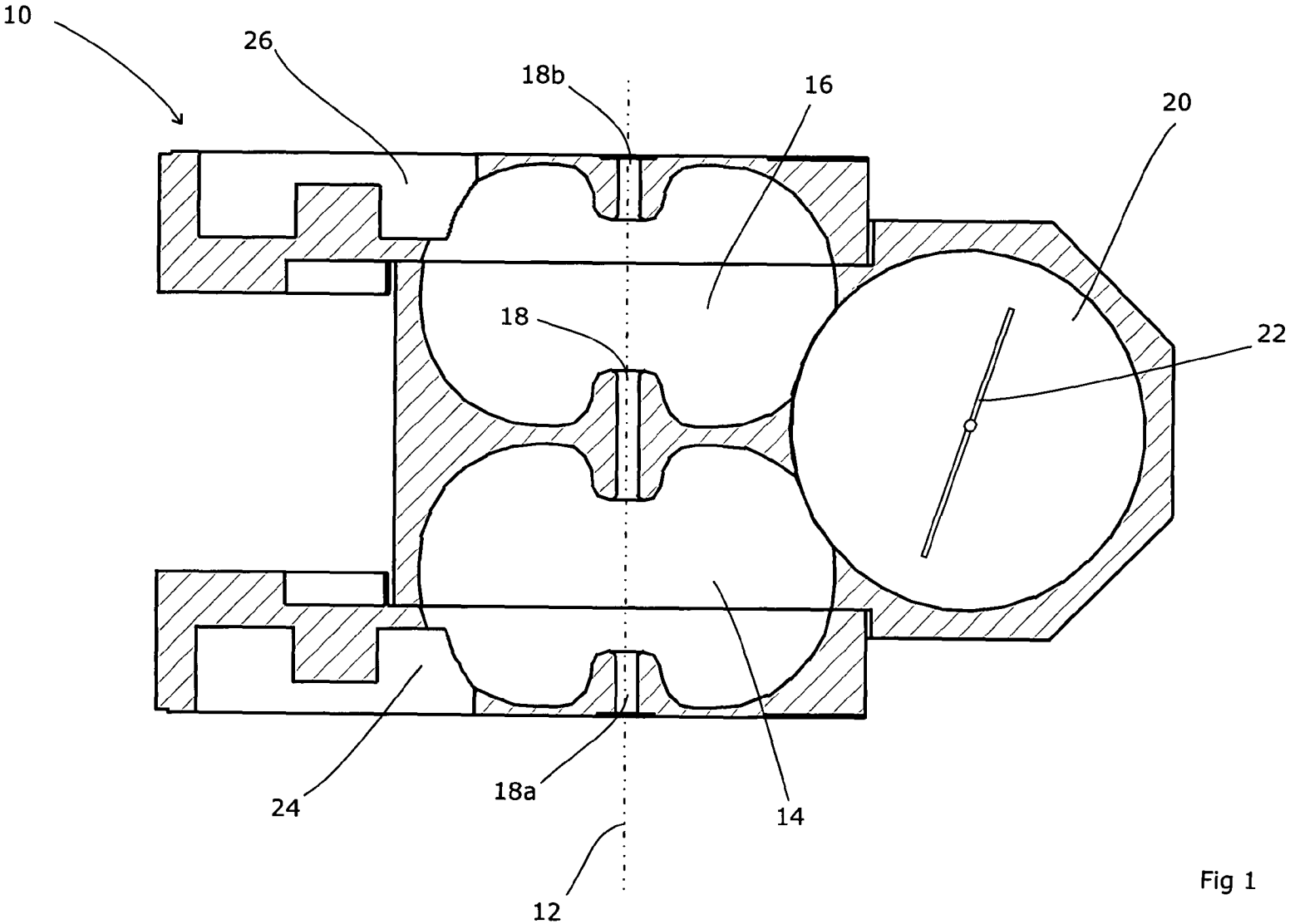
FIG. 1 shows a view of a pair of accelerator cavities and the coupling cavity between them.

Our application WO2006/097697A1 showed the basis of an x-ray apparatus able to switch effectively 'instantaneously' from a therapeutic energy to an imaging energy, to allow imaging during therapy but with no overhead in time and utilising a much simpler construction. FIG. 1 shows the coupling cavity of the linac 10 disclosed in WO-A-99/40759 and WO2006/097697A1. A beam 12 passes from an '$n^{th}$' accelerating cavity 14 to an '$n+1^{th}$' cavity 16 via an axial aperture 18 between the two cavities. Each cavity also has a half-aperture 18*a* and 18*b* so that when a plurality of such structures are stacked together, a linear accelerator is produced.

Each adjacent pair of accelerating cavities can also communicate via "coupling cavities" that allow the radiofrequency signal to be transmitted along the linac and thus create the standing wave that accelerates electrons. The shape and configuration of the coupling cavities affects the strength and phase of the coupling. The coupling cavity 20 between the $n^{th}$ and $n+1^{th}$ cavities is adjustable, in the manner described in WO-A-99/40759, in that it comprises a cylindrical cavity in which is disposed a rotateable vane 22. As described in WO-A-99/40759 and WO-A-01/11928 (to which the skilled reader is referred), this allows the strength and phase of the coupling between the accelerating cells to be varied by rotating the vane, as a result of the rotational asymmetry thereof.

It should be noted that the vane is rotationally asymmetric in that a small rotation thereof will result in a new and non-congruent shape to the coupling cavity as "seen" by the rf signal. A half-rotation of 180° will result in a congruent shape, and thus the vane has a certain degree of rotational symmetry. However, lesser rotations will affect coupling and therefore the vane does not have complete rotational symmetry; for the purposes of this invention it is therefore asymmetric.

The $n^{th}$ accelerating cavity 14 is coupled to the $n-1^{th}$ by a fixed coupling cell. That is present in the structure illustrated in FIG. 1 as a half-cell 24. This mates with a corresponding half-cell in the adjacent structure. Likewise, the $n+1^{th}$ accelerating cell 16 is coupled to the $n+2^{th}$ such cell by a cell made up of the half-cell 26 and a corresponding half-cell in an adjacent structure.

The radiation is typically produced from the linac in short pulses of about 3 microseconds, approximately every 2.5 ms. To change the energy of a known linac, be that by way of the rotateable vane described above or by other previously known means, the linac is switched off, the necessary adjustment is made, and the linac is re-started.

According to the invention, the rotateable vane 22 is caused to continuously rotate with a period correlated to the pulse rate of the linac. Thus, in this example the period is 2.5 ms i.e. 400 revolutions per second or 24,000 rpm. The radiation is then produced at a particular position of the vane or a particular phase of the rotation. Given that the linac is active for only 0.12% of the time, the vane will (at most) rotate through slightly less than half a degree and thus will be virtually stationary as "seen" by the rf signal.

This phase of the linac's pulse can be easily changed from one pulse to the next. This therefore allows the energy to be switched from one pulse to the next, since changing the phase correlates with the selection of a different vane angle.

In the adjustable coupling cell 20, the electric fields are symmetrical on either side of the vane. It therefore follows that the vane spin speed can in fact be reduced by a factor of 2 compared to that suggested above, which allows a lesser spin speed of 12,000 rpm to be adopted.

Figure 2:
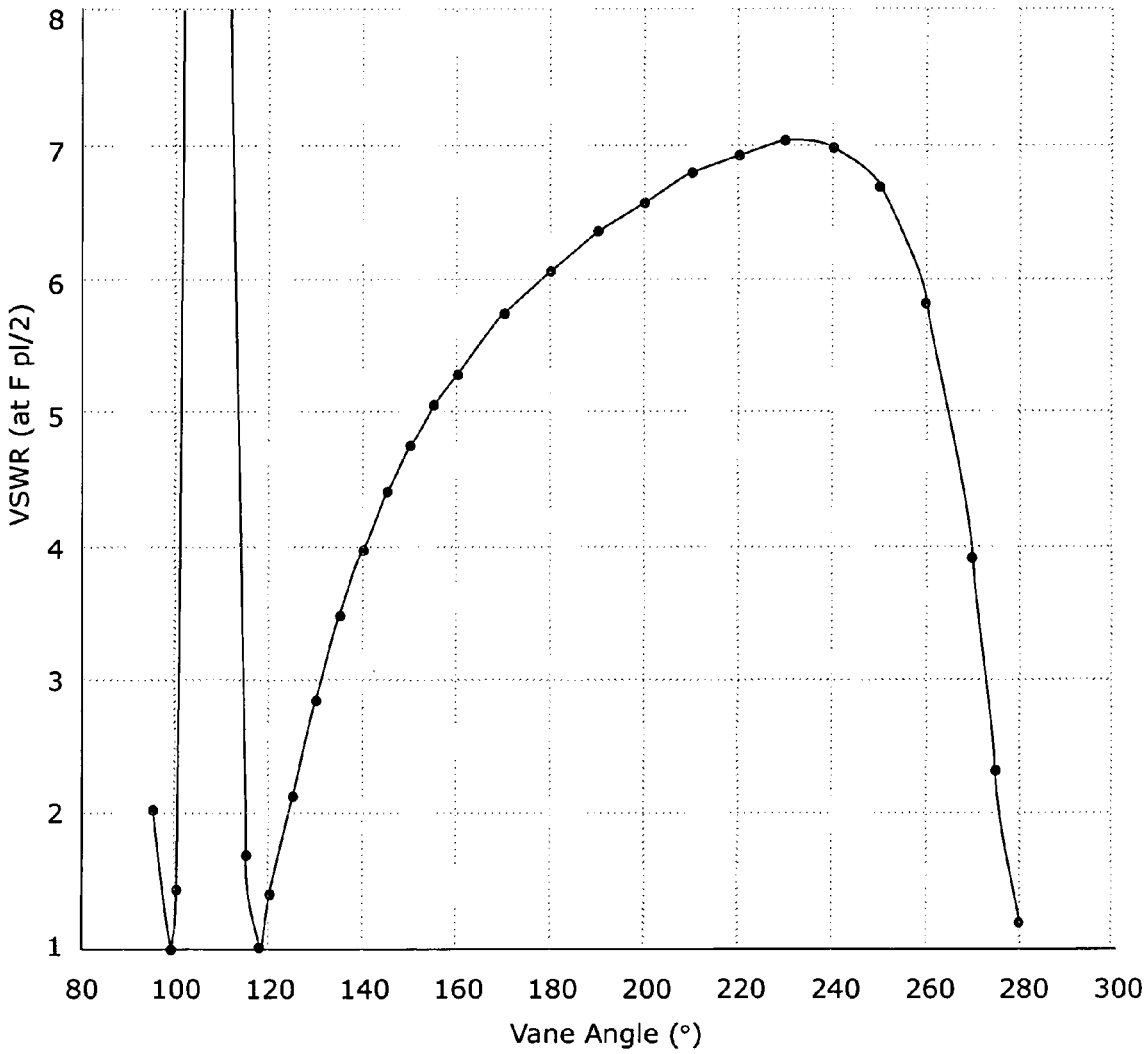
FIGS. 2 and 3 show characteristic curves for the accelerator, FIG. 2 showing the variation in linac impedance with vane angle.

FIG. 2 illustrates a practical aspect of the use of such a system. As may be seen in the Voltage Standing Wave Ratio (VSWR) vs vane angle plot, there are two "danger zones" in the angle ranges of 100°-120° and 280°-300°, in which the waveguide is under coupled. They should be avoided, by use of a suitable control mechanism.

Figure 3:
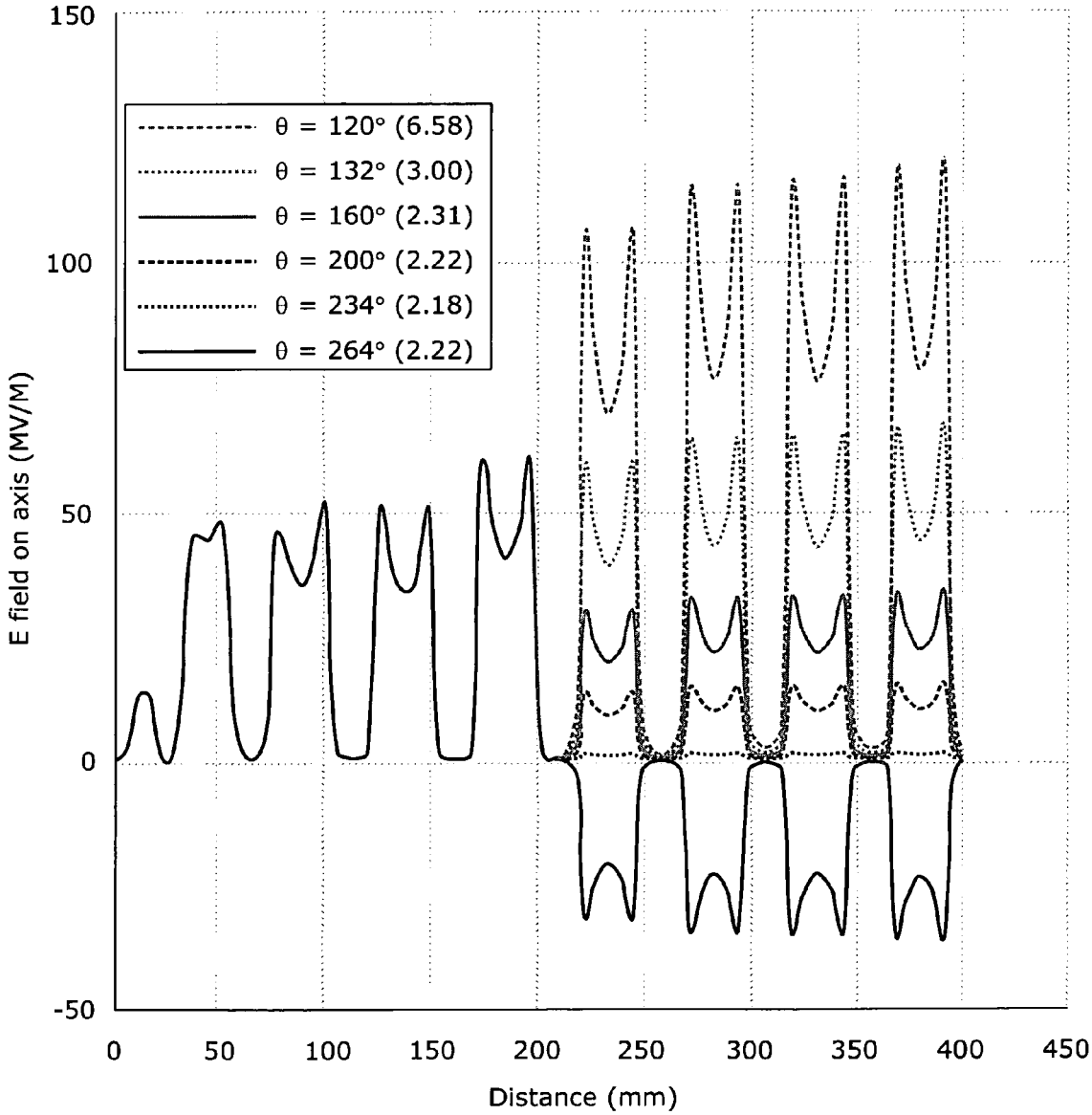

Within the working range of 120° to 280°, there are benefits in adjusting the input power according to the vane angle, to maintain the electric field constant. This is mainly due to the fact that the VSWR of the whole waveguide changes with the vane angle. FIG. 3 shows the input power required (in brackets) at different angles, together with the varying electrical field developed after the adjustable coupling cell at 200 mm along the linac. These varying electric fields translate into a varying energy of the electrons produced by the linac. Note that at 264° the electric field after the adjustable coupling cell is reversed; this decelerates the electrons and results in a very low diagnostic energy as described in WO-A-01/11928.

This idea can also be used to servo the actual energy of the beam to take account of variations in other systems.

The ability to vary the energy pulse to pulse could be used to control the depth dose profile pulse to pulse. This could be of benefit on a scanned beam machine where the ability to vary the energy across the radiation field could be used to produce less rounded isodose lines.

A further advantage of being able to vary the energy so rapidly would be to vary the therapy beam energy when in electron mode, thereby extending the irradiated volume receiving 100% of the dose. This could also be useful in Energy modulated electron therapy (EMET) or modulated electron radiotherapy (MERT) techniques. The fast switching of the electron energy and possibly the scattering foil could enable these techniques to be delivered more quickly, provided that suitable electron beam collimation could be provided.

Figure 4:
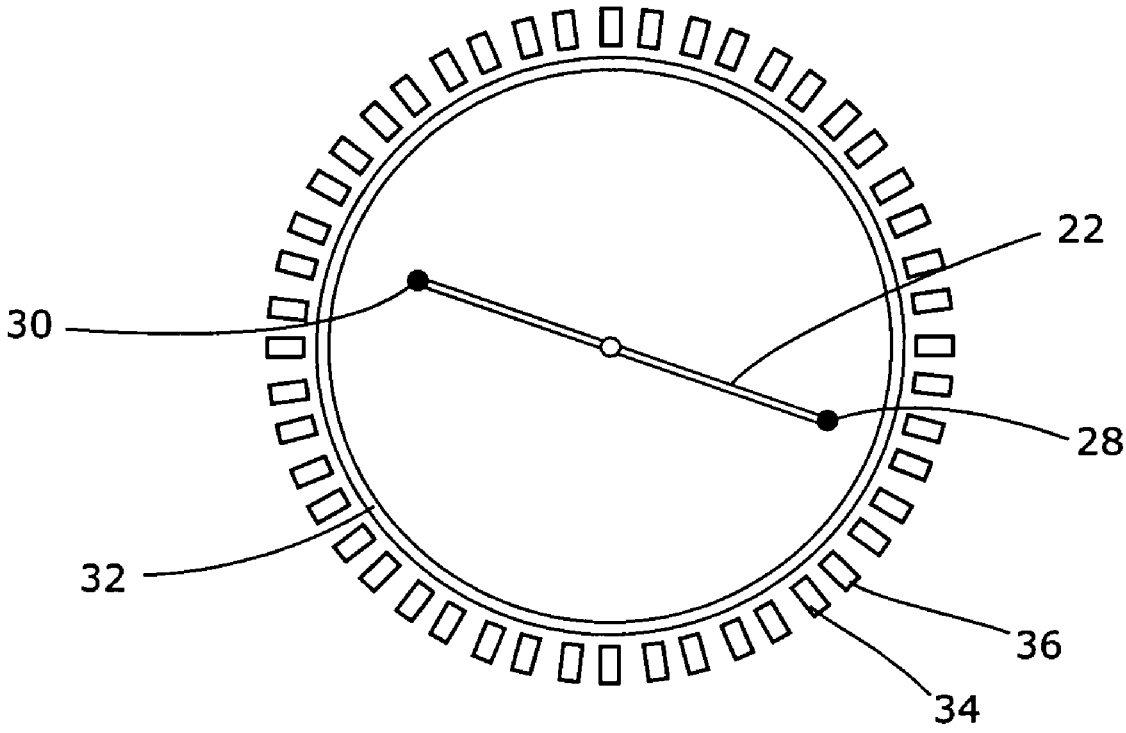
FIG. 4 shows an arrangement for rotating the asymmetric element.

FIG. 4 shows a possible mechanism by which the vane 22 can be rotated continuously. The vane does of course sit in an evacuated volume, so evidently a suitable shaft could be provided, with appropriate sealing, to transmit rotation from a motor outside the evacuated volume. Alternatively, as shown illustratively in FIG. 4, a magnetic control system could be provided. In this arrangement, the vane 22 is provided with magnetically polarised sections 28, 30 on either end. Then, outside the vacuum seal 32, an array of electrical coils 34, 36 etc are provided. These can then interact with the polarised sections 28, 30 in the manner of a stepper motor.

The above description allows for the production of a beam of electrons at a selectable energy. This can then be converted to a beam of x-rays by directing the electron beam at a suitable target. According to known principles of x-ray production, this produces a beam of x-rays which can then be collimated (etc) to produce a therapeutically or diagnostically useful output.

A potential problem in this is that the target is usually chosen in the light of the electron and x-ray energies involved. For example, a lower energy diagnostic beam (i.e. one comprising low energy photons such as with an energy below 200 KeV) can be produced from a megavoltage electron beam by directing the beam to a thinner or a lower atomic number target, Carbon being one example (see D. M. Galbraith, "*Low-energy imaging with high-energy bremsstrahlung beams", Med. Phys.* 16(5), 734-46 (1989)), whereas a high energy therapeutic beam is produced by directing a suitable electron beam to a thicker or higher atomic number target, Tungsten being an example. Whilst it is possible to select a compromise target material, a better beam quality is achievable by matching the target material to the selected energy.

In fact, in such circumstances, the Carbon target serves two purposes—to produce photons and to remove electrons which would otherwise increase the patient skin dose. At very low energies (circa 400 KeV) the majority of photons can arise from the electron window itself, and thus a significant part of the function of the Carbon target is to act as an electron filter.

Figure 5:
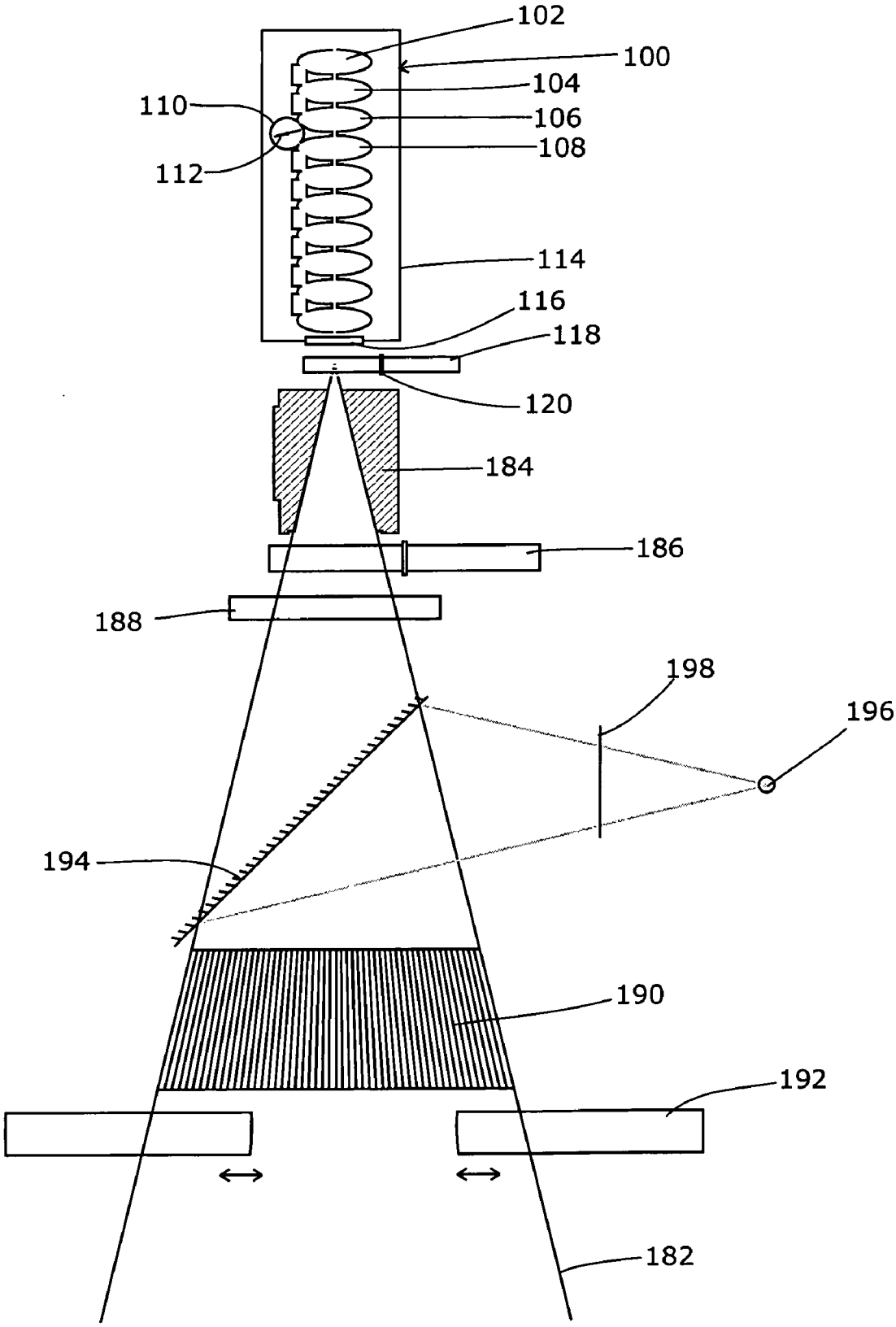
FIG. 5 shows an axial section along an x-ray apparatus according to the present invention.

This can be done as shown in FIG. 5. A linear accelerator comprises a series of sequential accelerating cells 102, 104, 106, 108 etc. Between cells 106 and 108, the third and fourth cells, there is a variable coupling cell 110 which is designed according to the principles of the variable coupling cell 20 of FIG. 1 and includes a continuously rotating vane 112 as described with respect to FIG. 4. The accelerator is enclosed within a vacuum enclosure 114 which has an output window 116 through which the electron beam produced by the linear accelerator 100 passes. The beam then impinges on a target 118.

The target 118 is generally disc-shaped and is mounted on a central axle 120 which is driven by an external motor (not shown) so that the target 118 rotates. The target 118 and the axle 120 are located relative to the linear accelerator 100 so that the electron beam impinges at a location on the target that is offset from the centrally-mounted axle 120. Thus, as the target 118 rotates, the relatively narrow electron beam will pass through the disc-shaped target at a point or points on a circular path.

The target 118 is rotationally asymmetric, and includes different regions made up of different materials. Thus, as the electron beam impinges on different parts of the target 118, a different target material is presented at the point of impingement. It therefore only remains to control the rotation and/or the pulse timings so that successive pulses of differing energy electron beams meet the appropriate location on the target 118.

Figure 6:
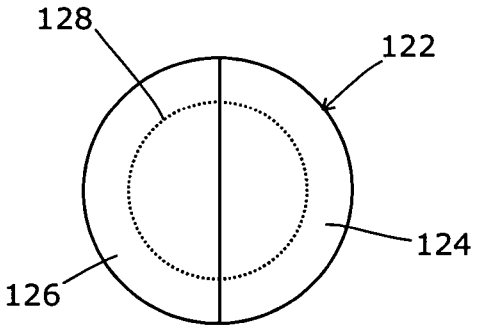
FIGS. 6 to 11 show alternative designs of target for the x-ray apparatus of FIG. 5.

FIGS. 6 to 11 show different possible designs of the target 118. FIG. 6 shows a simple target 122 that is constructed from two half-discs 124, 126, each semicircular in plan view. In this example, one is of Tungsten and the other is of Carbon, and the two are joined along their straight edge to form a single disc-shaped target 122. As this rotates, it alternately presents W or C locations to the impinging electron beam 128. Provided that rotation of the target 122 is synchronised to the varying energy pulses, the appropriate target material will therefore be presented at the appropriate time.

Figure 7:
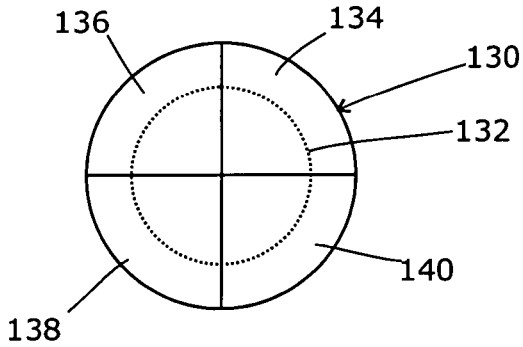

FIG. 7 shows an alternative design of target 130. Instead of being divided into halves, this target 130 is divided into four quarters. Alternate quarters are of alternating material, thus as the target 130 rotates, the path 132 followed by the electron beam across the target 130 traverses a Tungsten quarter 134, which is then replaced by a Carbon quarter 136, then by a Tungsten quarter 138, then by a Carbon quarter 140 which is then replaced by the original Tungsten quarter 134 after a complete revolution. At the expense of a slight increase in constructional complexity, the permits the rotational speed of the target to be halved.

Naturally, a greater number of segments could be provided in order to permit the rotational speed to be reduced still further. Even numbers such as 6, 8, 10 segments (etc) will suit arrangements in which two target materials are provided, but other numbers may be suited to arrangements using three or more different target materials, or the target geometry could be adjusted in this way to cater for periodic variations in pulse timing. For example, if the variation in output energy is used to control the depth penetration of the radiation then provision might be made for an option to provide an occasional pulse at a different position of the rotating vane 112 in order to allow such a third energy level. This would be at a different phase point, and could thus be made to correspond to a different segment of the target.

Figure 8:
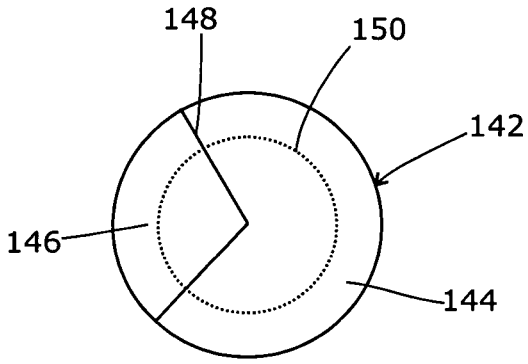

FIG. 8 shows a further form of target 142 in which a larger Tungsten area 144 and a smaller Carbon area 146 are joined to form the disc-shaped target 142. Thus, the join between the two segments is an acute angle, with the larger Tungsten segment occupying about 240° and the smaller Carbon segment being the remainder. The path 150 traced on the target 142 by the electron beam thus spends longer on the Tungsten segment 144; this could be useful if the therapeutic beam energy is to be varied, as this will necessitate waiting for a slightly different position of the rotating vane 112 and hence a different phase point; the greater area of the Tungsten segment 144 allows some latitude to accommodate this variation in timing. Of course, a larger Carbon segment could alternatively be provided if multiple diagnostic energies are to be provided, as is sometimes called for.

Figure 9:
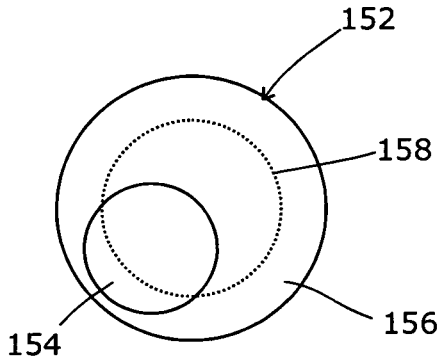

FIG. 9 shows a potentially more robust target 152 in which a smaller disc 154 of Carbon is inset within a suitable aperture in a larger disc 156 of Tungsten. As the target 152 rotates, the Carbon disc 154 is retained more securely in the Tungsten disc 156, whilst the path 158 traced by the electron beam still alternates between Carbon and Tungsten. The materials could of course be reversed as required.

Figure 10:
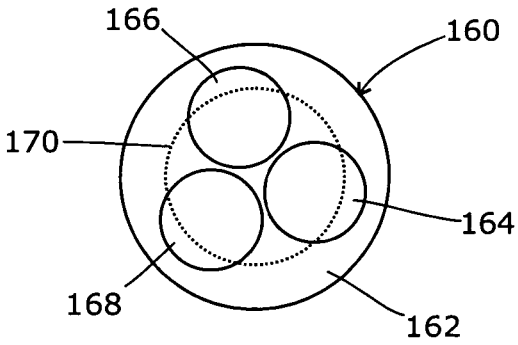

FIG. 10 shows a slower-rotating version 160 of the target of FIG. 9. A Tungsten disc 162 has several apertures, in this case three, in which Carbon discs 164, 166, 168 are placed. Thus, as the target 160 rotates, the path 170 of the electron beam again alternates between Tungsten and Carbon but does so several times in one revolution. Accordingly, the rotational velocity can be reduced. Naturally, a greater or lesser number of inserts 164, 166, 168 can be provided as desired, and/or the materials reversed.

Figure 11:
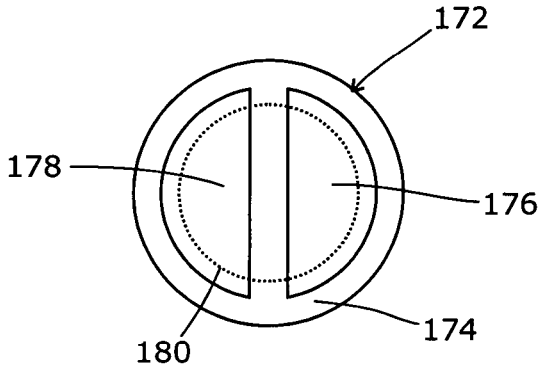

FIG. 11 shows a slightly different design of target 172. A substrate 174 is generally disc-shaped, and can be of any material having suitable mechanical properties. Two generally semi-circular inserts 176, 178 are provided in the substrate 174, one of Tungsten and the other of Carbon. As the target 172 rotates, the path 180 traced by the electron beam crosses alternately from the Tungsten insert 176 to the Carbon insert 178. As the beam path crosses from one to the other, it briefly passes over the substrate material, but it is to be expected that the pulse timing will be adjusted so that such "crossover" times are not chosen for a pulse, as minor errors in the pulse timing may result in misplacing the beam.

Other geometries for the inserts could be adopted, following the general geometries of FIGS. 6 to 11, or otherwise. Likewise, other rotationally asymmetric geometries for the targets of FIGS. 6 to 11 could be adopted.

It should be emphasised that other materials could be used for the active regions of the targets. Tungsten and Carbon have been used in the above discussion as examples as they are the most common choices, but other materials are also suitable.

Returning to FIG. 5, the x-ray beam 182 produced at the rotating target 118 is then limited generally by a primary collimator 184. Normally, the beam will be filtered at this point, such as to flatten it or for diagnostic purposes. Diagnostic x-ray filters are usually made of Aluminium and enable the quality of the x-ray beam to be adjusted, for example to remove very low energy photons (<30 KeV) from an x-ray beam and thereby reduce the patient skin dose. Again, the filter will typically be specific to the beam energy, presenting a potential difficulty if the beam energy varies.

Thus, a flattening filter can be omitted or replaced with a uniform material and an unflattened beam employed (according to generally known principles).

Alternatively (as illustrated) a rotating filter housing 186 can be provided. This is a disc-shaped substrate carrying a plurality of filters, usually two, located in the substrate at an angular position so that when a pulse of a specific energy is emitted from the target 118, the appropriate filter is presented by the rotating filter substrate 186. If a flattening filter is used in this housing, then it is required that it is accurately positioned. Using an unflattened beam has the advantage of using a uniform or no filter for which the position is not critical.

From there, the beam then passes through an ion chamber 188, a multi-leaf collimator 190 and a block collimator 192, and/or such collimation as is required for the specific application in which the x-ray apparatus is employed. FIG. 5 also shows a mirror 194 placed in the path of the beam 182; this can be used to project visible light from a lamp 196 and filter 198 along the beam path 182 and hence check alignment, patient positioning etc.

Some form of detector will be needed for at least the diagnostic radiation. A range of flat panel detectors are suitable, and many are able to withstand the higher energy therapeutic radiation that will be transmitted through the patient. In particular, GEM (Gas Electron Multiplier) detectors, solid state, and CCD detectors, and active pixel sensors based on CMOS technology could be suitable and at least one can be located on the beam path with the patient between it and the apparatus shown in FIG. 5.

A suitable detector could be based on the technologies illustrated and described in U.S. Pat. No. 6,429,578 B1, WO 2005/120046, and EP1762088, in the thesis "New Efficient Detector for Radiation Therapy Imaging using Gas Electron Multipliers" submitted by Janina Östling to Stockholm University, 17 Mar. 2006, ISBN 91-7155-218-9, and in the paper "Empirical electro-optical and X-ray performance evaluation of CMOS active pixels sensor for low dose, high resolution X-ray medical imaging" by Costas Arvanitis, Sarah Bohndiek, Gary Royle, Andrew Blue, Huang XingLiang, Andy Clark, Mark Prydderch, Renato Turchetta, and Robert Speller, *Medical Physics* 34 (2007) 4612-4625. Active pixel sensors are discussed in the article available at http://medicalphysicsweb.org/cws/article/research/31467. The contents of these documents are incorporated herein by reference, and the reader should be aware that the present application should be read in conjunction with these documents, the content of which may be used by way of amendment to this application.

The detector of this example is operated in synchrony with the switching energy. To capture images from the low energy pulse only, the detector can be reset immediately after a high energy pulse. Alternatively, to capture both low energy images and portal images, the detector can be switched between modes adapted to each energy in synchrony with the energy switching.

It will of course be understood that many variations may be made to the above-described embodiment without departing from the scope of the present invention.

The invention claimed is:

1. X-ray apparatus comprising:

a linear accelerator that produces a beam of electrons at one of at least two selectable energies;

a non-homogeneous target that receives the electron beam and in response produces a beam of x-radiation; and control means for periodically changing the selected energy of the electron beam and synchronously moving the target with the change of the selected energy.

2. X-ray apparatus according to claim 1, wherein the control means moves the target rotationally.

3. X-ray apparatus according to claim 1 in which the linear accelerator comprises a series of accelerating cavities, adjacent pairs of which are coupled via coupling cavities, at least one coupling cavity comprising a rotationally asymmetric element that is rotated by the control means to vary the coupling offered by that cavity and thereby select an energy.

4. X-ray apparatus according to claim 3, wherein the control means further operates the accelerator in a pulsed manner and rotates the asymmetric element between pulses to control the energy of successive pulses.

5. X-ray apparatus according to claim 3, wherein the control means continuously rotates the asymmetric element during operation of the linear accelerator.

6. X-ray apparatus according to claim 1 in which the target is immersed in a coolant fluid.

7. X-ray apparatus according to claim 6 in which the fluid is predominantly water.

8. X-ray apparatus according to claim 1 in which the target contains at least one exposed area of a first material and at least one exposed area of a second material that is different to the first material.

9. X-ray apparatus according to claim 1 in which the target contains at least one exposed area of tungsten.

10. X-ray apparatus according to claim 1 in which the target contains at least one exposed area of carbon.

11. X-ray apparatus according to claim 1 in which the target has a thickness containing inhomogeneities.

12. X-ray apparatus according to claim 1 in which the target is made of a homogenous material which contains the inhomogeneities.

13. X-ray apparatus according to claim 1, further comprising a filter housing containing a plurality of filters for the x-radiation, wherein the control means drives the housing to move periodically in synchrony with the change of the selected energy.

14. X-ray apparatus according to claim 1, further comprising a detector located in the path of the electron beam to acquire an image produced by the electron beam after attenuation thereof.

15. X-ray apparatus according to claim 14, wherein the control means operates to drive the detector in synchrony with the changes to the selected energy of the linear accelerator.

16. Radiotherapy apparatus comprising a source of X-radiation according to claim 1.

17. Radiotherapy apparatus according to claim 16 in which a first selected energy is a diagnostic energy and a second selected energy is a therapeutic energy.

* * * * *